US007794527B2

(12) United States Patent
Sterner

(10) Patent No.: US 7,794,527 B2
(45) Date of Patent: Sep. 14, 2010

(54) VARIABLE POSITION GAS TRAP

(75) Inventor: Steven Michael Sterner, Broken Arrow, OK (US)

(73) Assignee: Fluid Inclusion Technologies, Inc., Broken Arrow, OK (US)

( * ) Notice: Subject to any disclaimer, the term of this patent is extended or adjusted under 35 U.S.C. 154(b) by 456 days.

(21) Appl. No.: 11/861,986

(22) Filed: Sep. 26, 2007

(65) Prior Publication Data

US 2009/0077936 A1 Mar. 26, 2009

(51) Int. Cl.
*B01D 19/00* (2006.01)

(52) U.S. Cl. ..... 96/157; 96/214; 96/217; 73/19.09

(58) Field of Classification Search ..... 96/156, 96/217, 196, 214, 157; 95/24, 261; 73/19.09, 73/19.12, 152.04, 152.19, 863.21
See application file for complete search history.

(56) References Cited

U.S. PATENT DOCUMENTS

| | | | | |
|---|---|---|---|---|
| 2,429,555 | A | 10/1947 | Langford et al. | |
| 2,489,180 | A | 11/1949 | Hayward | |
| 2,748,884 | A | 6/1956 | Erwin | |
| 3,055,743 | A * | 9/1962 | Anderson | 422/96 |
| 3,118,738 | A | 1/1964 | Jamieson | |
| 3,362,136 | A | 1/1968 | Burnham, Sr. et al. | |
| 3,363,404 | A | 1/1968 | Griffin, III et al. | |
| 4,084,946 | A * | 4/1978 | Burgess | 96/188 |
| 4,113,452 | A | 9/1978 | Brown et al. | |
| 4,358,298 | A * | 11/1982 | Ratcliff | 96/189 |
| 4,381,191 | A | 4/1983 | Brand et al. | |
| 4,447,247 | A | 5/1984 | Naess | |
| 4,565,086 | A | 1/1986 | Orr, Jr. | |
| 4,731,732 | A | 3/1988 | Warchol et al. | |
| 4,833,915 | A | 5/1989 | Radd et al. | |
| 4,887,464 | A | 12/1989 | Tannenbaum et al. | |
| 5,007,488 | A | 4/1991 | Donovan | |
| 5,199,509 | A | 4/1993 | Wright et al. | |
| 5,447,052 | A | 9/1995 | Delaune et al. | |
| 5,648,603 | A | 7/1997 | Hanson | |
| 6,389,878 | B1 | 5/2002 | Zamfes | |
| 7,210,342 | B1 * | 5/2007 | Sterner et al. | 73/152.18 |
| 2002/0017193 | A1 | 2/2002 | Ramos | |
| 2004/0265176 | A1 | 12/2004 | Kerherve et al. | |
| 2006/0202122 | A1 | 9/2006 | Gunn et al. | |
| 2006/0254421 | A1 | 11/2006 | Boone | |

OTHER PUBLICATIONS

Drilgas, "Built-in Valve" / "Unique Degasser".

* cited by examiner

*Primary Examiner*—Duane Smith
*Assistant Examiner*—Douglas J Theisen
(74) *Attorney, Agent, or Firm*—Head, Johnson & Kachigian, P.C.

(57) ABSTRACT

A variable position gas trap apparatus and method to separate gases entrained in drilling fluid in a tank. The apparatus includes a gas trap attached to a carriage and a frame attached to the tank. A lever moveable by the float rod, activates the control valve to raise or lower the carriage having the gas trap container attached thereto. A feedback control loop is responsive to changes in the level of the drilling fluid in the tank. A mechanism is provided to mechanically and automatically move the carriage with respect to the frame in response to the feedback control loop.

15 Claims, 9 Drawing Sheets

VARIABLE POSITION GAS TRAP

BACKGROUND OF THE INVENTION

1. Field of the Invention

The present invention is directed to a variable position gas trap apparatus and method used to separate gases entrained in drilling fluid in a tank. In particular, the present invention is directed to a variable position gas trap apparatus wherein a feedback control loop mechanically and automatically adjusts the height of the gas trap in response to changes in the level of the drilling fluid in the tank.

2. Prior Art

The use of drilling fluid or fluids while drilling subterranean wells is well-known. The drilling fluid or fluids may be aqueous-based, but are most often hydrocarbon or petroleum-based. The drilling fluids are referred to as base fluid, drilling mud or, simply, mud. Drilling fluid is used for a number of reasons. The drilling fluid is pumped downhole to the site where the drill bit is operating and is used to carry dirt, debris, rocks and chips broken off by action of the drill bit. The drilling fluid also assists in cooling the area where the drill bit operates. The drilling fluid may contain other additives, such as special lubricants, and is relatively expensive.

The drilling fluid is typically contained in a closed looped system. Upon return to the surface from downhole, the drilling fluid is often processed with a vibrating shaker or "shale shaker" which contains a screen so that the drilling fluid passes through the screen while rocks or other items above a certain size are separated out. The drilling fluid is stored in an open container or tank or a series of containers and then returned back down hole in a continuous system.

It has been discovered that the drilling fluid which returns from the downhole drilling location will return with downhole gas bubbles. The content of these gas bubbles provides extremely valuable information on the presence of hydrocarbons, such as natural gas. Monitoring of the gas content and composition as a function of depth is sometimes referred to as "mud logging".

Assignee's U.S. Pat. No. 7,210,342 entitled "Method and Apparatus for Determining Gas Content of Subsurface Fluids for Oil and Gas Exploration" discloses one example of a system to analyze the gas content of bubbles entrained within the drilling fluid.

Over the years, there have been various devices that have been developed to liberate the gas bubbles which are entrained in the drilling fluid. Zamfes (U.S. Pat. No. 6,389,878) shows one example of a gas trap. A canister or container is partially submerged in the drilling fluid in the mud tank and permits drilling mud to enter from the base and exit from a side. The gas trap includes a motor which rotates a blade or stirrer to assist in releasing gas bubbles which are then taken to a gas collection port for analysis.

There are various types of gas traps, but most of them operate on similar basic principles. The gas traps are strapped or otherwise secured inside of the drilling mud tank. Changes in the operation of the drilling equipment or the drilling fluid pump can alter the level of fluid in the tank. If the drilling mud level in the tank or container changes the operation of the gas trap may be affected. If the level of the drilling mud is too low, not enough mud will enter the gas trap, so that primarily atmospheric air will enter the gas trap. If the level of drilling fluid is too high, it may affect the efficiency of separation of the gas bubbles from the drilling fluid or, in an extreme case, mud may enter the analysis equipment. While it is possible to manually move the gas trap in response to changes in the level, there is an ongoing effort to minimize required personnel at a drilling location.

Prior devices include Ratcliff (U.S. Pat. No. 4,358,298) which discloses a rack gear 66 that operates with a pinion gear 86 so that manual rotation of a crank 90 permits vertical adjustment of the gas trap. No automatic adjustment is provided.

Naess (U.S. Pat. No. 4,447,247) discloses a submerged mechanism to collect gas flowing into a body of water with an upper member 2 and ballast tanks 13 for adjusting the displacement of the upper member in an underwater blow-out.

Also in the past, a standard gas trap has been encapsulated in a buoyant sheath without any feedback control loop or mechanical assistance to respond to changes in the mud level. Despite the simplicity, the large footprint comprises its utility.

Notwithstanding the foregoing, it is desirable to provide a variable position gas trap apparatus wherein the position of the gas trap will automatically vary with the level of the mud in the tank.

It is also desirable to provide an apparatus that will operate with a wide variety of existing gas trap designs.

It is also desirable to provide a variable position gas trap apparatus having a feedback control loop for height adjustment.

It is also desirable to provide a variable position gas trap that is compact in design and reliable in operation.

SUMMARY OF THE INVENTION

The present invention provides a variable position gas trap apparatus utilized to separate gases which are entrained in drilling fluid in a container or a tank. The present invention provides for automatic height adjustment in response to surface level change of the drilling fluid.

The apparatus operates with and includes a gas trap container having an open base and a motor wherein the motor rotates a shaft. Extending from the shaft is a stirrer which extends into the gas trap container to stir the drilling fluid and assists in releasing gases contained within the drilling fluid.

The gas trap container and the motor are attached to a carriage which is substantially parallel to a wall or walls of the tank and substantially perpendicular to the level of the drilling fluid. The carriage includes a pair of parallel guide tubes.

The variable position gas trap apparatus also includes a frame attached to the tank. The frame includes a pair of parallel guide rods which are substantially parallel to the wall or walls of the tank and substantially perpendicular to the level of the drilling fluid in the tank.

The guide tubes of the carriage are coaxial with the guide rods of the frame so that the guide tubes and accompanying carriage are permitted to travel and ride along the guide rods of the frame. In one embodiment, a buoyant float is attached to the carriage. Extending from the buoyant float is an extending float rod which passes through a float rod cover.

The carriage and the accompanying gas trap container and motor are moved with respect to the frame by action of a cylinder. One end of the cylinder is pivotally attached to the frame and the opposite end of the cylinder is connected to the carriage through an extending ram or piston.

As the level of drilling fluid in the tank increases, the buoyant float will likewise move upward which will cause the extending float rod to move upward and will move a lever to cause activation of a control valve to activate the cylinder causing the piston to extend. The extension of the piston raises the gas trap container.

BRIEF DESCRIPTION OF THE DRAWINGS

FIG. 5 illustrates the action of the variable position gas trap apparatus in response to a rising level of drilling fluid while

DETAILED DESCRIPTION OF THE PREFERRED EMBODIMENTS

The embodiments discussed herein are merely illustrative of specific manners in which to make and use the invention and are not to be interpreted as limiting the scope of the instant invention.

While the invention has been described with a certain degree of particularity, it is to be noted that many modifications may be made in the details of the invention's construction and the arrangement of its components without departing from the spirit and scope of this disclosure. It is understood that the invention is not limited to the embodiments set forth herein for purposes of exemplification.

Figure 2:
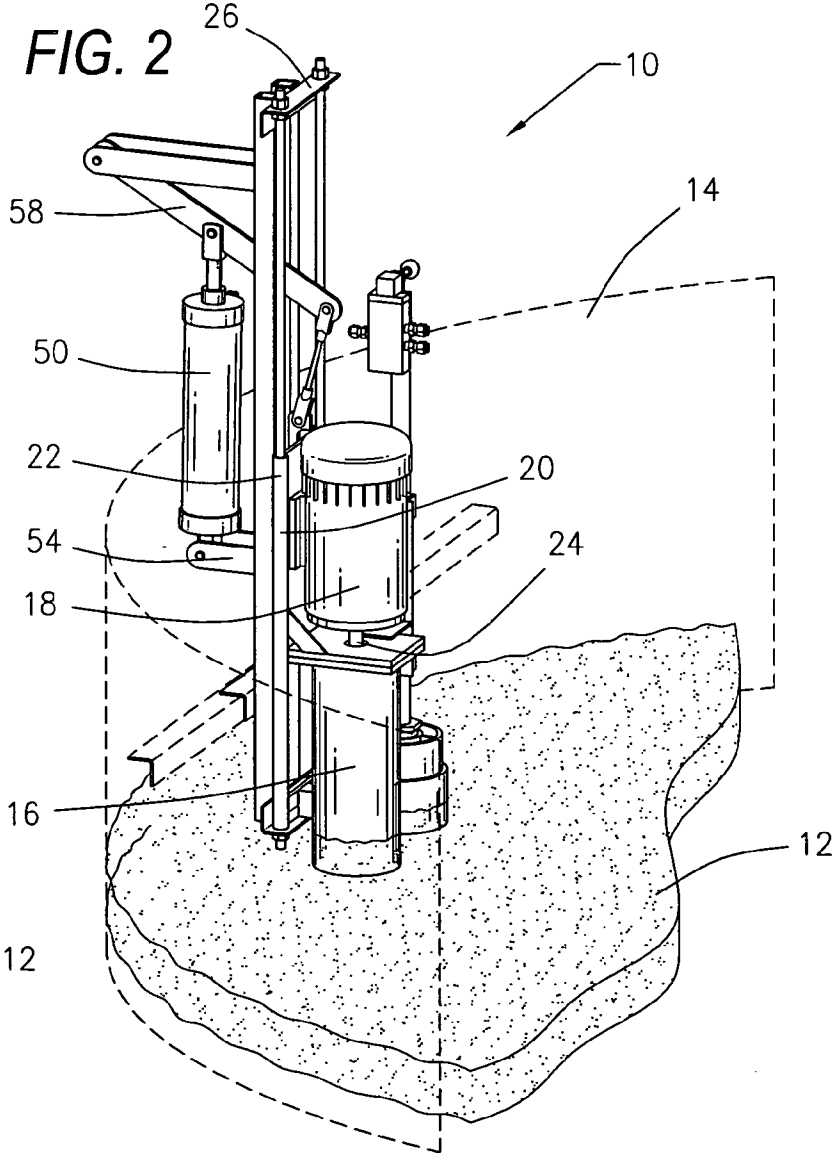
FIGS. 1 and 2 illustrate perspective views of an initial preferred embodiment of a variable position gas trap apparatus constructed in accordance with the present invention in a tank (shown by dashed lines) wherein the level of the drilling fluid in the tank varies.
Figure 1:
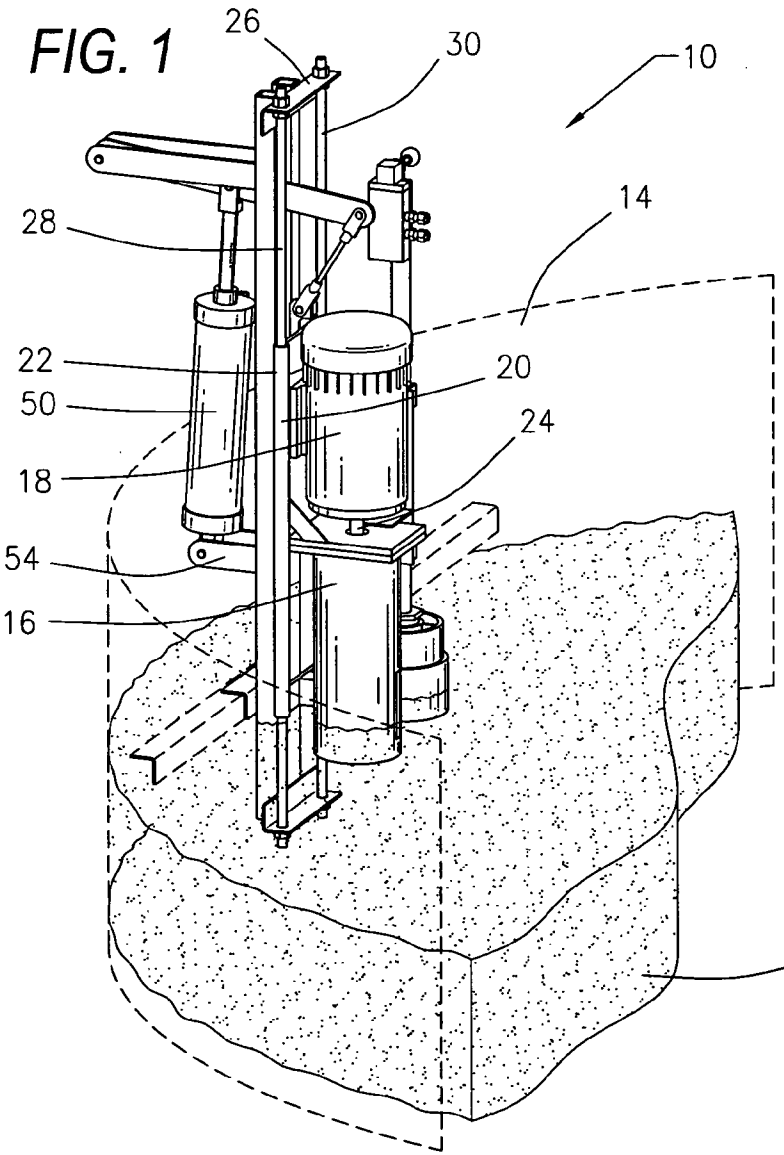

Referring to the drawings in detail, FIGS. 1 and 2 illustrate perspective views of a variable position gas trap apparatus 10 utilized to separate gases entrained in drilling fluid 12 in a container or tank 14 (shown by dash lines) wherein the level of the drilling fluid 12 in the tank 14 varies. Various hoses which are a part of the apparatus are not shown in FIGS. 1 and 2 for clarity.

The present invention provides automatic height adjustment in response to changes in the surface level of drilling fluid 12 in the tank 14.

The variable position apparatus 10 includes a gas trap container 16 having an open base and a motor 18 wherein the motor 18 rotates a shaft 24. Extending from the shaft 24 is a stirrer 32 which extends into the gas trap container 16 to stir the drilling fluid and assist in releasing gases contained within the drilling fluid 12. Various designs and configurations of known gas trap containers might be utilized.

It will be understood that an electric motor 18 might be employed or, alternatively, a pneumatic or other type of motor might be used within the spirit and scope of the present invention.

The gas trap container 16 and the motor 18 are attached to a carriage 20 which is substantially parallel to the wall or walls of the tank 14 and substantially perpendicular to the level of the drilling fluid 12 in the tank. The gas trap container 16 and the motor 18 may be attached to the carriage by fasteners, by welding, or by other mechanism. In a preferred embodiment, the carriage 20 includes a pair of parallel hollow guide tubes 22 and 23.

The variable position gas trap apparatus 10 also includes a frame 26. The frame 26 is attached to the tank 14 in any of a variety of manners. The frame 26 includes a pair of parallel guide rods 28 and 30. The guide rods are substantially parallel to the wall or walls of the tank 14 and substantially perpendicular to the level of the drilling fluid 12 in the tank.

The guide tubes of the carriage are coaxial with the guide rods of the frame. Each of the guide tubes 22 and 23 on the carriage 20 has an inside diameter slightly larger than the outside diameter of each of the guide rods 28 and 30. Accordingly, the guide tubes and the accompanying carriage 20 are permitted to travel and ride along the guide rods 28 and 30 of the frame 26.

Also attached to the carriage 20 is a buoyant float 34, which will float on the drilling fluid 12 in the tank 14. The buoyant float may take the form of a hollow sphere. Extending from the buoyant float 34 is an extending float rod 36.

Figure 3:
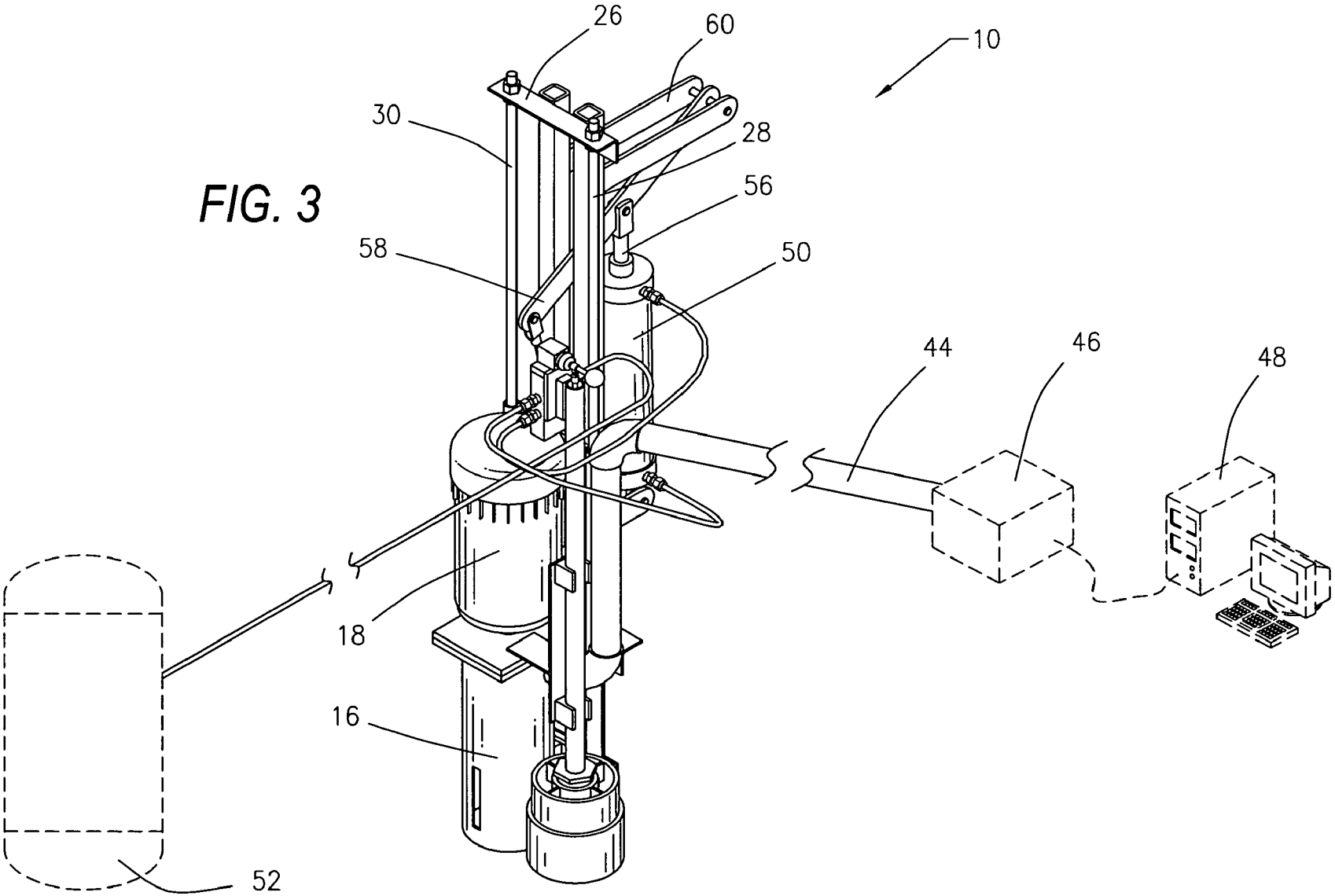
FIG. 3 illustrates a perspective view of the variable position gas trap apparatus shown in FIGS. 1 and 2 apart from the tank and the drilling fluid.
Figure 4:
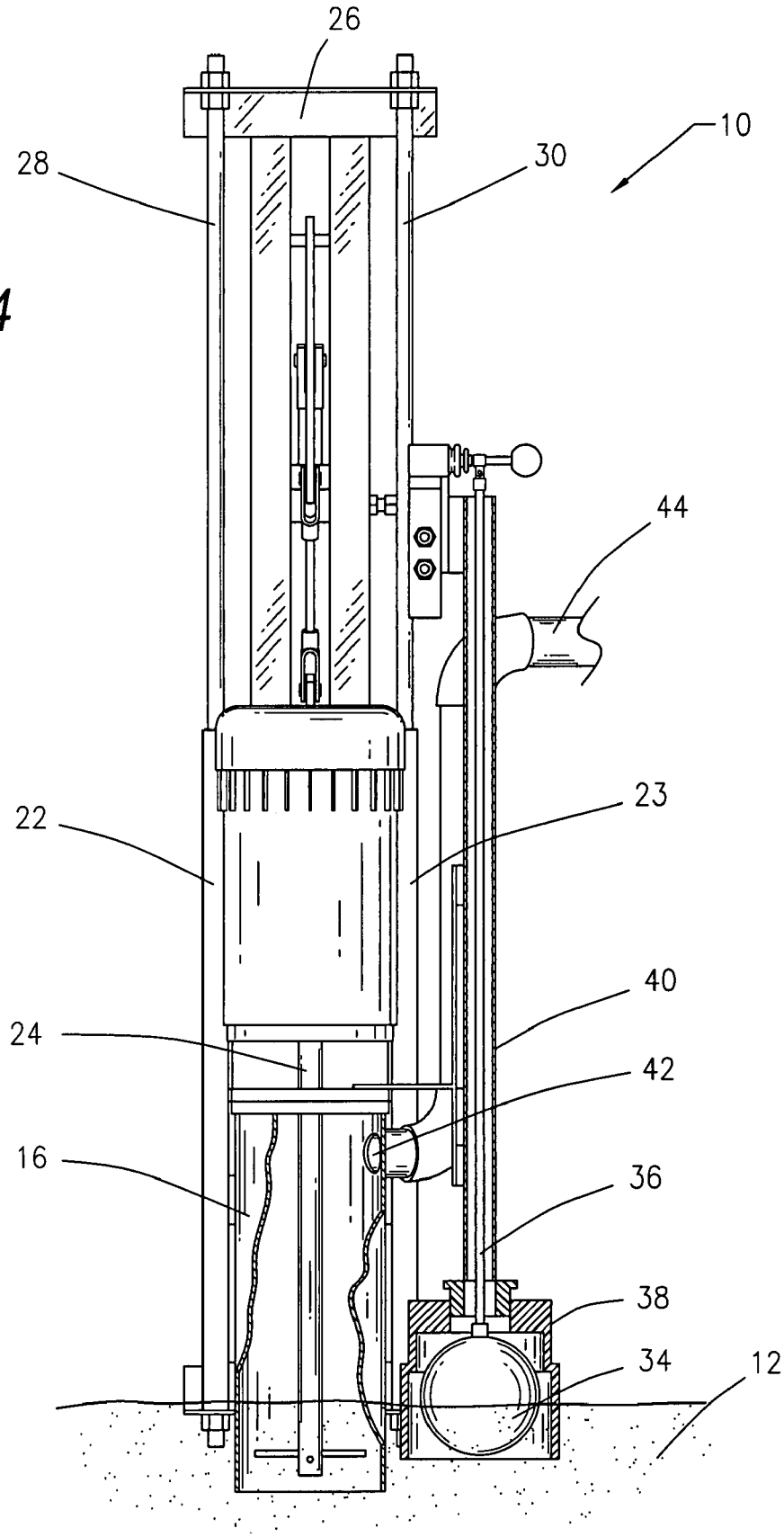
FIG. 4 illustrates a side view of the apparatus shown in FIGS. 1 through 3 partially cut away for ease of viewing.

FIG. 3 illustrates a perspective view of the gas trap apparatus 10 apart from the mud tank 14 and drilling fluid 12 and FIG. 4 illustrates a side view of the apparatus 10 partially cut away for ease of viewing. The buoyant float 34 may be surrounded by an optional shroud 38 to prevent the float from being damaged. The extending float rod 36 passes through a float rod cover 40.

As gases are liberated from the drilling fluid 12, the gases will rise to the top of the container 16 and be permitted to pass through a port 42 (visible in FIG. 4) and thereafter delivered through a line 44 to an analyzer 46 (shown in dashed lines) or other similar equipment, which may in turn, be connected with and operate with certain computer equipment 48, all as is well known.

The carriage 20 and the accompanying gas trap container 16 and motor 18 are moved with respect to the frame by action of a cylinder 50, which may be powered by pneumatic power supplied from a pneumatic system 52. Alternatively, the cylinder 50 might be powered by hydraulics or by an electric motor (not shown).

One end of the cylinder 50 is pivotally attached to the frame 26 through an extending ear 54. The opposite end of the cylinder 50 is connected to the carriage 20, as will be described, through an extending ram or piston 56. In the first preferred embodiment, the piston 56 is pivotally connected to a lever arm 58. The lever arm 58 is also connected at a first end which acts as a lever point to the frame 26 at a cantilever arm 60.

Another end of the lever arm 58 opposed to the first end is pivotally attached to the carriage 20 through a pivotal link 62. A chain or other connection might alternately be utilized.

Figure 6:
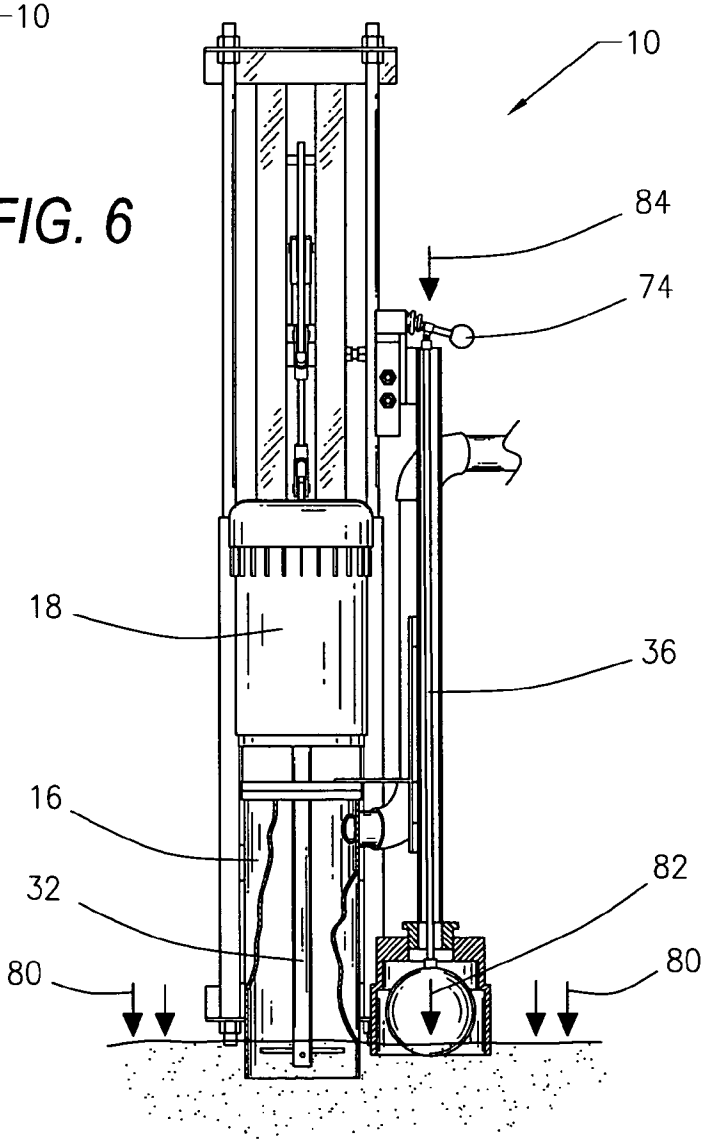
FIG. 6 illustrates the action of the apparatus in response to a decrease in the level of the drilling fluid.
Figure 5:
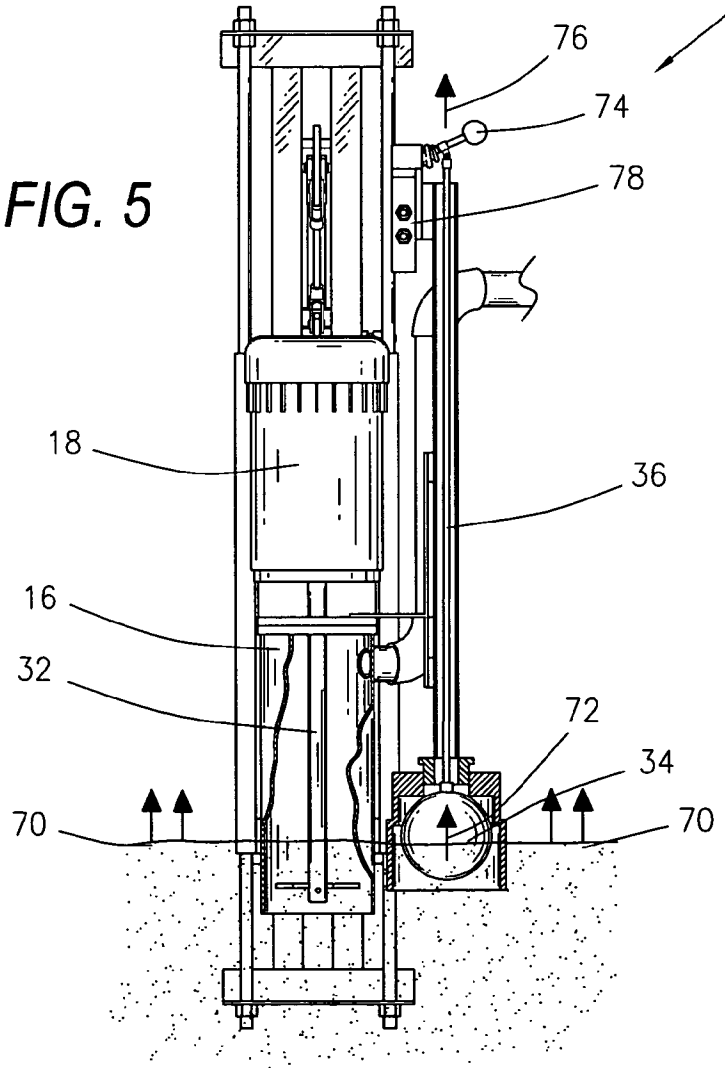

It is desirable to retain the gas trap container 16 partially submerged in the drilling fluid. FIG. 5 illustrates the action of the apparatus 10 in response to a rising level of drilling fluid 12. FIG. 6 illustrates the action of the apparatus 10 in response to a decrease in the level of the drilling fluid 12.

Referring to FIG. 5, as the level of drilling fluid 12 in the tank 14 increases as illustrated by arrows 70, the buoyant float 34 will likewise move upward as illustrated by arrow 72. This will cause the extending float rod 36 to likewise move upward within the float rod cover which will move a lever 74 as illustrated by arrow 76. The lever 74 will cause activation of a four-way control valve 78 (having five ports) to permit the pneumatic system 52 to activate the cylinder 50 (not visible), causing the piston 56 to extend. The extension of the piston 56 moves the lever arm 58, thereby raising the carriage 20 which, in turn, raises the gas trap container 16 and the actuator valve 78.

It will also be understood that the invention will work with other valves. For example, a two way valve (with 3 ports) might be employed with gravity used to move the carriage downward.

Conversely, as seen in FIG. 6, when the level of the drilling fluid 12 decreases, as shown by arrows 80, the buoyant float 34 will likewise move downward as illustrated by arrow 82. This will cause the extending float rod 36 to likewise move downward within the float rod cover which will move the lever 74 as illustrated by arrow 84. The lever 74 will cause activation of a four-way control valve 78 to permit the pneumatic system 52 to activate the cylinder 50 (not visible) causing the piston 56 of the cylinder 50 to retract. The retraction of the piston 56 moves the lever arm 58 which is connected to the carriage through the lever aim and link 62, thereby permitting the carriage 20 to lower the gas trap container 16.

Figure 8:
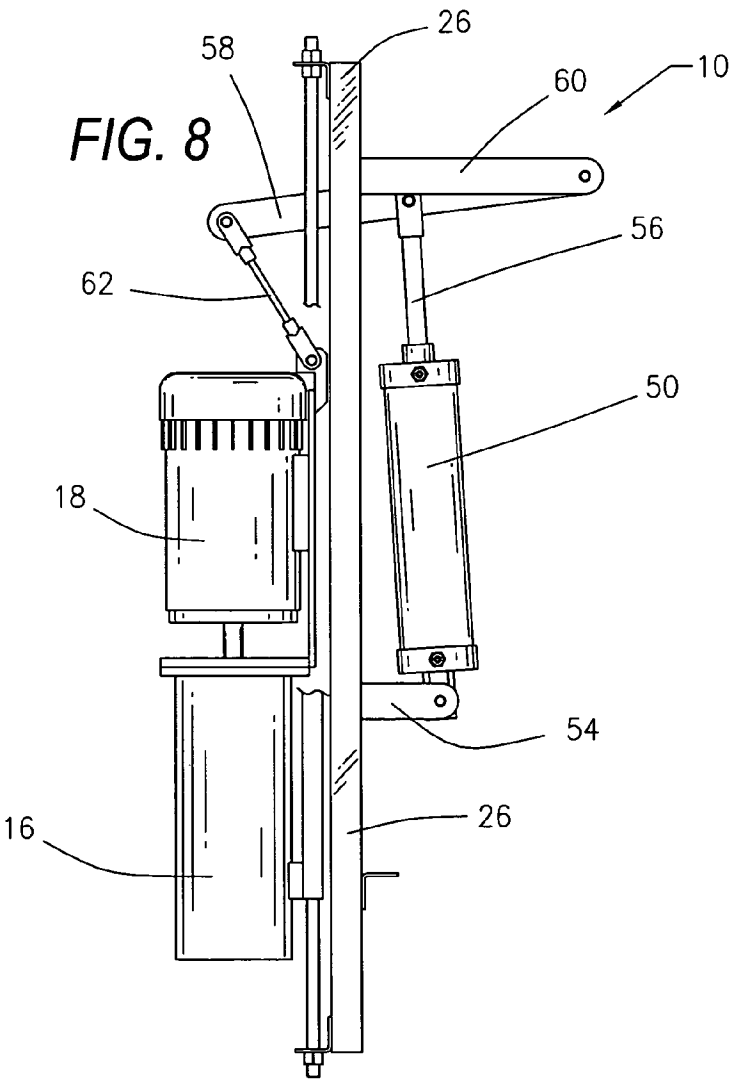
FIGS. 7 and 8 illustrate portions of the variable position gas trap apparatus to illustrate the linkage of the various component elements.
Figure 7:
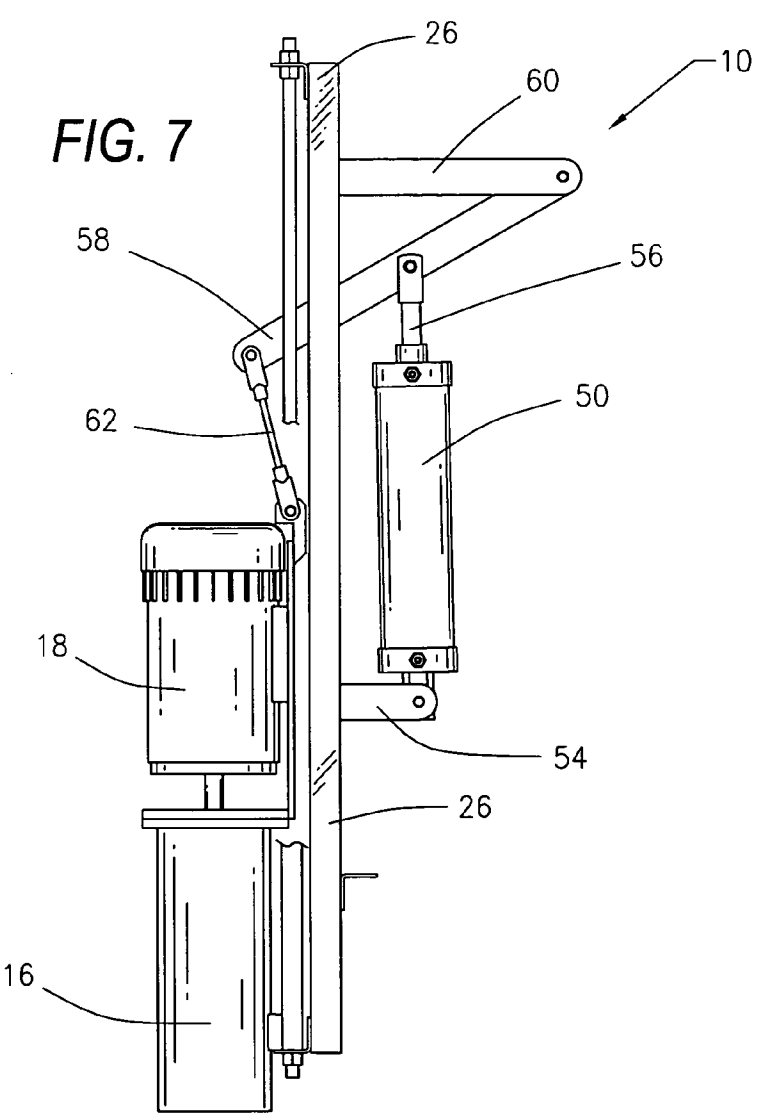

FIGS. 7 and 8 are side views of the apparatus 10 illustrating the mechanism to move the carriage with respect to the frame and, in particular, the linkage of the various constituent elements. The cylinder 50 is pivotally connected to the ear 54 extending from the frame 26. The piston 56 extending from the cylinder 50 is shown in an extended position in FIG. 8. As the piston 56 extends, the lever arm 58 pivots about the pivot point at the connection with the cantilever arm 60. As the piston 56 extends, the lever arm 56 is raised thereby raising the carriage through its connection with the link 62.

In summary, the present invention provides a feedback control loop which activates a mechanical apparatus resulting in automatic adjustment of the level of the gas trap.

Figure 9:
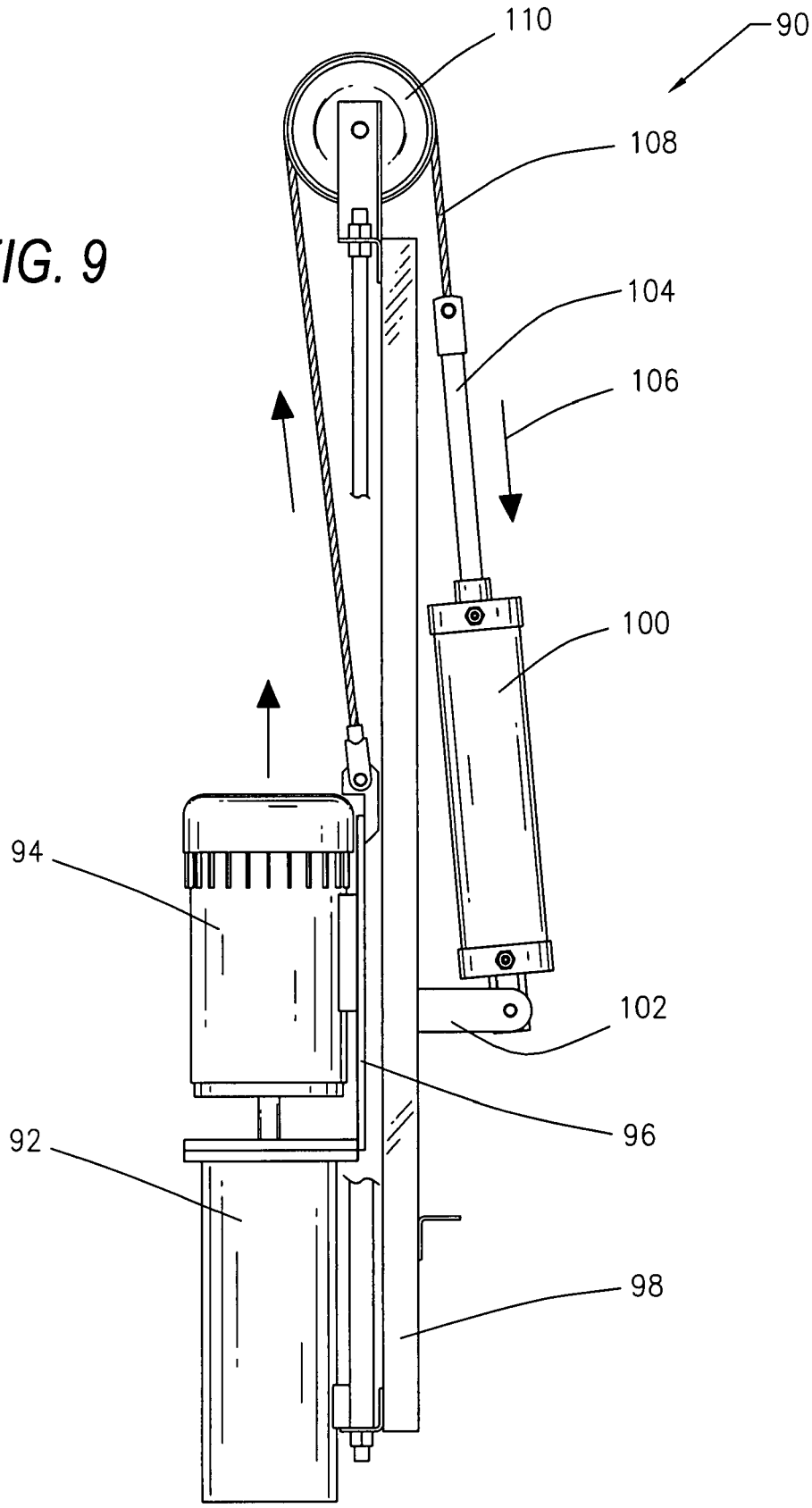
FIG. 9 illustrates a second preferred embodiment of the variable position gas trap apparatus of the present invention.

FIG. 9 illustrates a side view of a second, preferred embodiment 90 of the variable position gas trap apparatus. The embodiment 90 in FIG. 9 will operate in response to changing fluid levels as previously described. A gas trap container 92 and motor 94 are attached to a carriage 96 which moves with respect to a frame 98 as previously described. A cylinder 100 is pivotally attached to the frame at in extending ear 102. As a piston 104 is moved as shown by arrow 106, a cable, rope or wire 108 which is engaged with a pulley 110 moves the carriage 96, thereby raising or lowering the gas trap container 92.

The buoyant float and control valve are not shown in FIG. 9 for clarity.

In summary, the present invention provides a feedback control loop which activates a mechanical apparatus resulting in automatic adjustment of the level of the gas trap.

Figure 10:
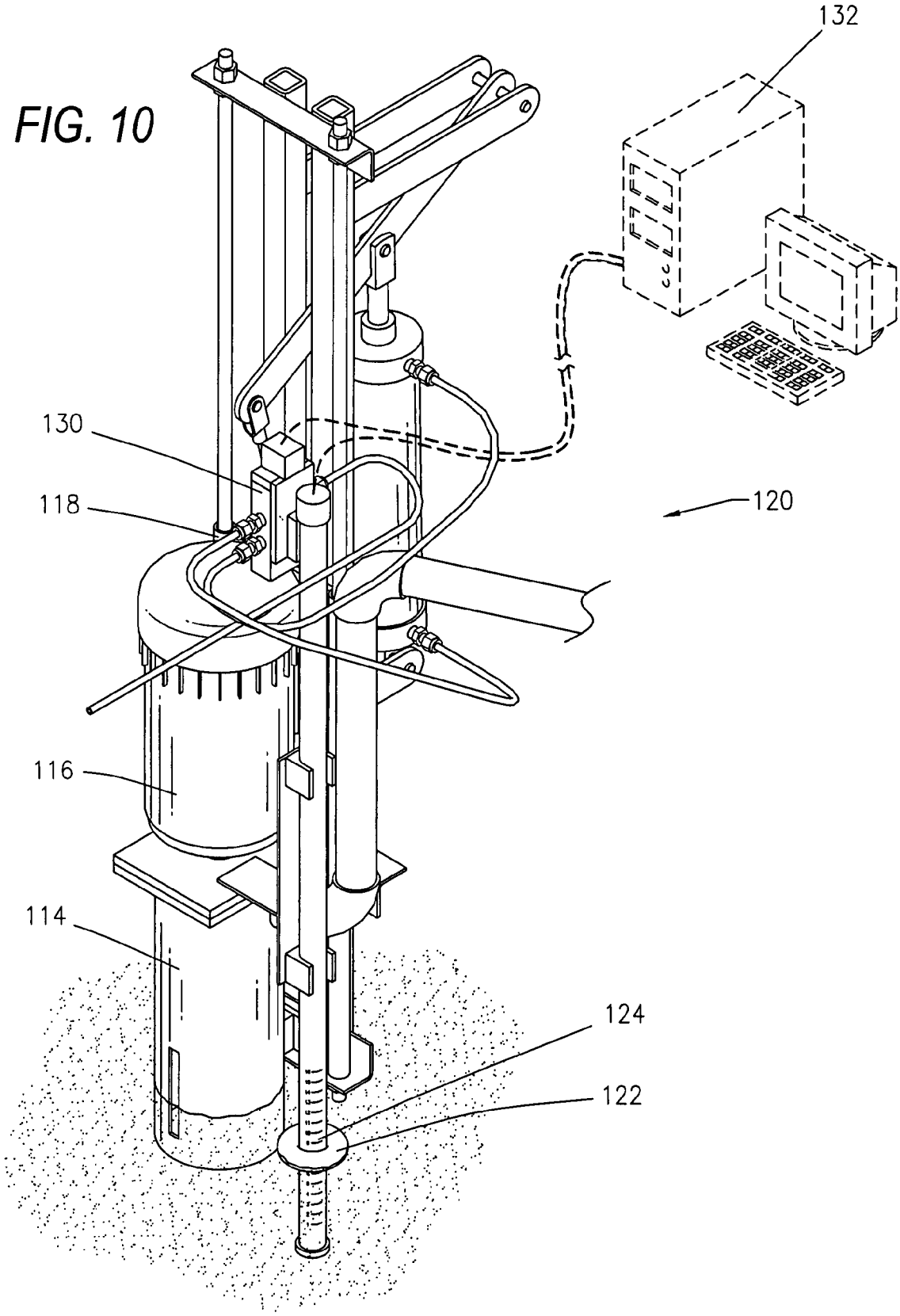
FIG. 10 illustrates a third preferred embodiment of the variable position gas trap apparatus of the present invention.

FIG. 10 illustrates a further, third preferred embodiment 120 of the variable position gas trap apparatus. A gas trap container 114 and motor 116 are mounted on a carriage 118 as previously described in detail in the first embodiment. A donut style float 122 surrounds a magnetic sensor pole 124 so that the position of the donut float 122 changes as the level of the drilling fluid in the tank changes. The level of the drilling fluid in the tank is sensed by the magnetic sensor 124. This information is electronically relayed to a control valve 130. The magnetic sensor and the control valve may be in communication with a computer 132. Alternately, the donut style float 122 might be designed with the magnetic sensor contained therein.

In summary, the present invention provides a feedback control loop which activates a mechanical apparatus resulting in automatic adjustment of the level of the gas trap.

Figures 11, 11A:
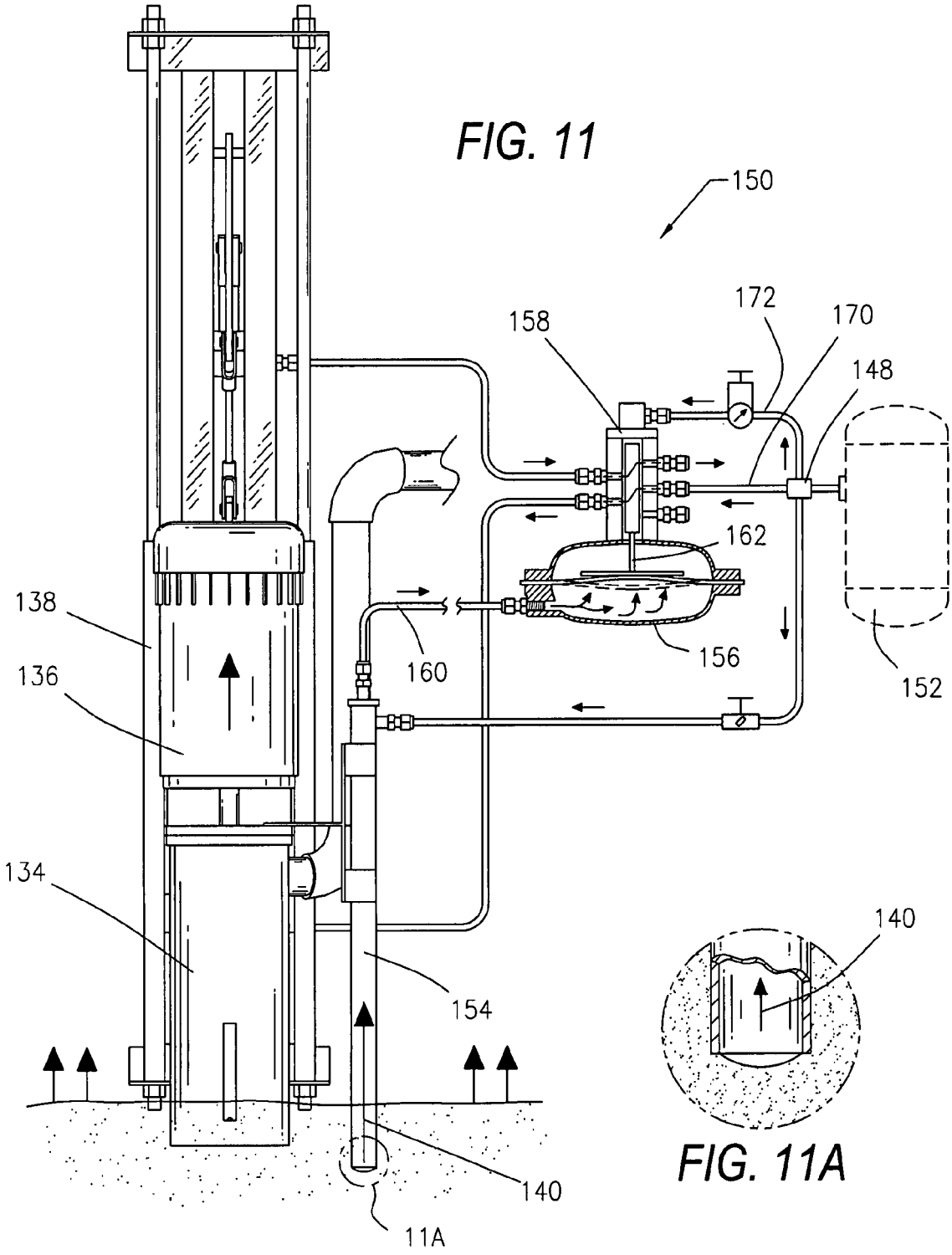
FIG. 11 illustrates a fourth preferred embodiment of the variable position gas trap apparatus of the present invention.
Figure 13:
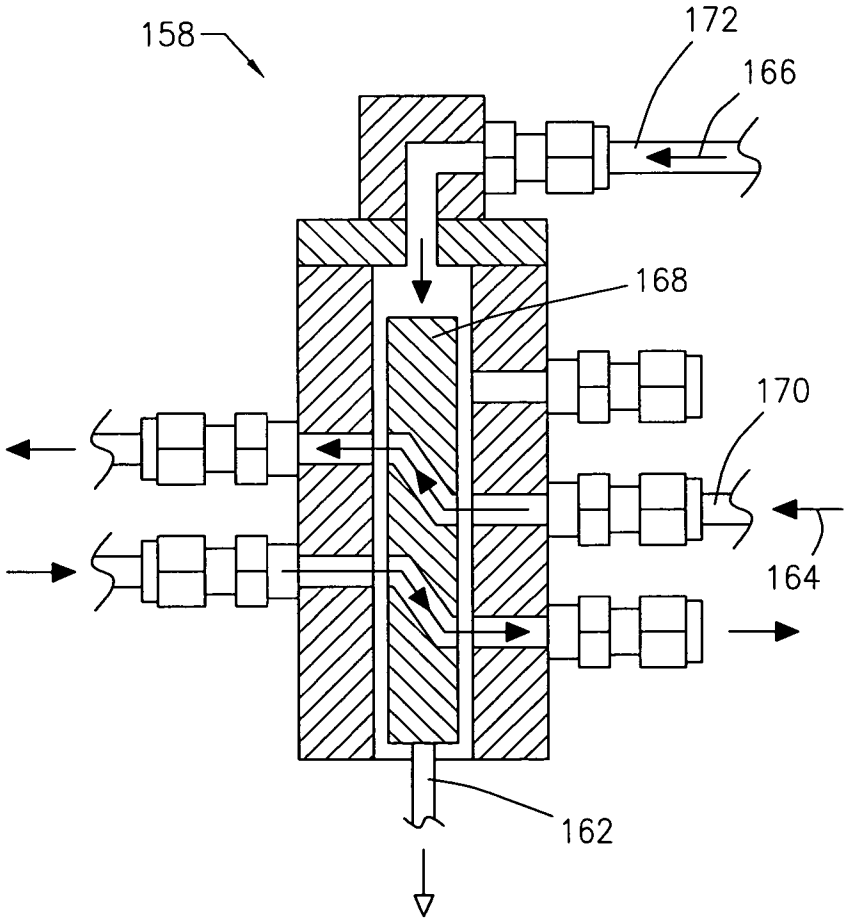
FIGS. 12 and 13 illustrate an example of operation of a four way valve utilized with the present invention.
Figure 12:
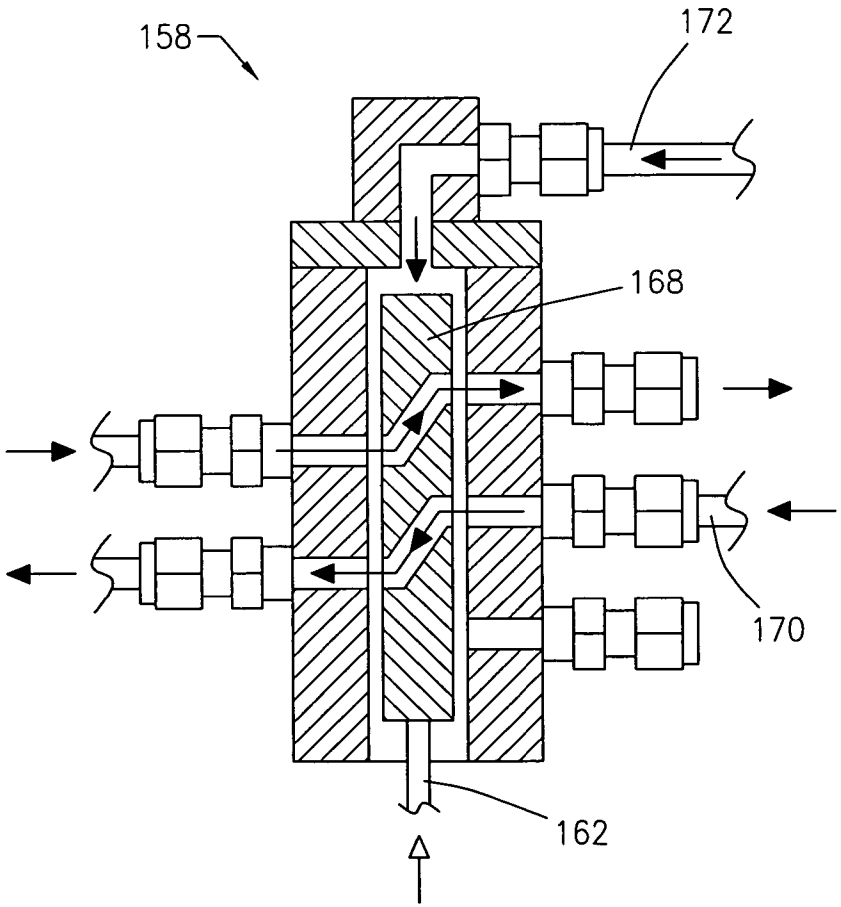

Finally, FIGS. 11, 12 and 13 illustrates a further, fourth preferred embodiment of an apparatus 150 for a variable position gas trap. A gas trap container 134 and a motor 136 are mounted on a carriage 138 as previously described in detail. A pneumatic air supply (shown by dashed lines 152) provides a constant pressure through a splitter 148 connected to line 170 as shown by arrow 164 to a hollow sensing tube 154 which is partially submerged in the drilling fluid. The pneumatic air supply will slowly force air bubbles from the sensing tube 154.

As shown by FIG. 11A, as the level of drilling fluid in the tank increases, the pressure within the sensing tube 154 will increase, as shown by arrow 140, thereby increasing the pressure in a diaphragm 156 connected to the tube 154 through a line or hose 160. The increase in pressure in the diaphragm 156 will activate a connecting rod 162 connected to a control valve 158, such as a four-way valve, which works in conjunction with a cylinder (not shown in FIG. 11) in similar fashion to that described in the first and second embodiments.

Extension of a piston (not shown) of the cylinder will move a lever arm to cause the carriage and the accompanying gas trap container and motor to rise, as previously described in detail.

FIGS. 12 and 13 illustrate an example of a five port, four way valve 158 shown in two extreme, opposed positions. As shown by arrow 166, air pressure is supplied from pneumatic air supply 152 through a line 172 to top of a spool 168 which is opposed to the force from connecting rod 162. In position shown in FIG. 12, the spool 168 will direct air pressure to the cylinder to raise the carriage, whereas in position in FIG. 13, the spool will direct air pressure to the cylinder to lower the carriage.

In summary, the present invention provides a feedback control loop which activates a mechanical apparatus resulting in automatic adjustment of the level of the gas trap.

Whereas, the present invention has been described in relation to the drawings attached hereto, it should be understood that other and further modifications, apart from those shown or suggested herein, may be made within the spirit and scope of this invention.

What is claimed is:

1. A variable position gas trap apparatus to separate gases entrained in drilling fluid in a tank, which apparatus comprises:

a gas trap container and a motor attached to a carriage wherein said carriage includes at least one guide tube;

a frame attached to said tank having at least one guide rod wherein said guide tube is movable with respect to said at least one guide rod;

a buoyant float attached to an extending float rod;

a cylinder attached on one side to said frame which moves said carriage with respect to said frame;

a control valve in communication with said cylinder;

a lever movable by said float rod, wherein said lever activates said control valve to raise or lower said carriage having said gas trap container attached thereto.

2. A variable position gas trap as set forth in claim 1 wherein said at least one guide tube comprises a pair of parallel guide tubes and wherein said at least one guide rod comprises at least one guide rod.

3. A variable position gas trap as set forth in claim 1 wherein said at least one guide tube and said at least one guide rod are coaxial and said at least one guide tube has an inner diameter slightly larger than an outer diameter of said guide rod.

4. A variable position gas trap as set forth in claim 1 wherein said motor rotates a shaft attached to a stirrer which extends into said gas trap container.

5. A variable position gas trap as set forth in claim 1 including a lever arm between said frame and said carriage.

6. A variable position gas trap as set forth in claim 1 including a cup or shroud surrounding said buoyant float.

7. A variable position gas trap as set forth in claim 1 wherein said control valve is a four-way valve.

8. A variable position gas trap apparatus to separate gases entrained in drilling fluid in a tank, which apparatus comprises:

a gas trap attached to a carriage wherein said carriage includes at least one guide tube;

a frame attached to said tank having at least one guide rod wherein said guide tube is moveable with respect to said guide rod;

a feedback control loop responsive to changes in the level of said drilling fluid in said tank wherein said feedback control loop includes a buoyant float attached to an extending float rod in communication with a control valve;

means to mechanically and automatically move said carriage with respect to said frame in response to said feedback control loop.

9. A variable position gas trap apparatus as set forth in claim 8 wherein said means to automatically move said carriage with respect to said frame includes a cylinder attached to said frame wherein said cylinder includes an extending piston connected to a lever arm and wherein said lever arm is pivotally attached to said frame so that said cylinder moves said carriage in response to said feedback control loop.

10. A variable position gas trap apparatus to separate gases entrained in drilling fluid in a tank, which apparatus comprises:

a gas trap attached to a carriage wherein said carriage includes at least one guide tube;

a frame attached to said tank having at least one guide rod wherein said guide tube is moveable with respect to said guide rod;

a feedback control loop responsive to changes in the level of said drilling fluid in said tank wherein said feedback control loop includes a magnetic sensor pole, a donut-style float, and a control valve in communication with said magnetic sensor pole;

means to mechanically and automatically move said carriage with respect to said frame in response to said feedback control loop.

11. A variable position gas trap apparatus as set forth in claim 10 wherein said means to automatically move said carriage with respect to said frame includes a cylinder attached to said frame wherein said cylinder includes an extending piston connected to a lever arm and wherein said lever arm is pivotally attached to said frame so that said cylinder moves said carriage in response to said feedback control loop.

12. A variable position gas trap apparatus to separate gases entrained in drilling fluid in a tank, which apparatus comprises:

a gas trap attached to a carriage wherein said carriage includes at least one guide tube;

a frame attached to said tank having at least one guide rod wherein said guide tube is moveable with respect to said guide rod;

a feedback control loop responsive to changes in the level of said drilling fluid in said tank wherein said feedback control loop includes a sensing tube in fluid communication with a diaphragm which activates a connecting rod connected to a control valve;

means to mechanically and automatically move said carriage with respect to said frame in response to said feedback control loop.

13. A variable position gas trap apparatus as set forth in claim 12 wherein said means to automatically move said carriage with respect to said frame includes a cylinder attached to said frame wherein said cylinder includes an extending piston connected to a lever arm and wherein said lever arm is pivotally attached to said frame so that said cylinder moves said carriage in response to said feedback control loop.

14. A variable position gas trap apparatus to separate gases entrained in drilling fluid in a tank, which apparatus comprises:

a gas trap attached to a carriage;

a frame attached to said tank;

a feedback control loop responsive to changes in the level of said drilling fluid in said tank wherein said feedback control loop includes a sensing tube in fluid communication with a diaphragm which activates a connecting rod connected to a control valve;

means to mechanically and automatically move said gas trap with respect to said frame in response to said feedback control loop.

15. A variable position gas trap apparatus to separate gases entrained in drilling fluid in a tank, which apparatus comprises:

a gas trap attached to a carriage;

a frame attached to said tank;

a feedback control loop responsive to changes in the level of said drilling fluid in said tank wherein said feedback control loop includes a buoyant float attached to an extending float rod in communication with a control valve;

means to mechanically and automatically move said gas trap with respect to said frame in response to said feedback control loop.

* * * * *